US006089888A

United States Patent [19]

Miller

[11] Patent Number: 6,089,888

[45] Date of Patent: Jul. 18, 2000

[54] RECEPTACLE ASSEMBLY WITH COVER POSITION INDICATING MEANS

[75] Inventor: Michael W. Miller, St. Louis, Mo.

[73] Assignee: Hubbell Incorporated, Orange, Conn.

[21] Appl. No.: 09/145,800

[22] Filed: Sep. 2, 1998

[51] Int. Cl.[7] ..... H01R 13/44

[52] U.S. Cl. ..... 439/142

[58] Field of Search ..... 439/142, 136, 439/135, 148, 320, 488; 220/296

[56] References Cited

U.S. PATENT DOCUMENTS

| | | | |
|---|---|---|---|
| 3,633,150 | 1/1972 | Swartz | 339/36 |
| 3,950,055 | 4/1976 | Samuela et al. | 339/44 R |
| 4,381,879 | 5/1983 | Ehrenfels et al. | 339/44 R |
| 4,902,238 | 2/1990 | Iacobucci | 439/135 |
| 5,571,023 | 11/1996 | JohnAnthony | 439/142 |
| 5,573,412 | 11/1996 | Anthony | 439/133 |
| 5,582,521 | 12/1996 | Mori et al. | 439/142 |
| 5,588,853 | 12/1996 | Anthony | 439/136 |

*Primary Examiner*—Renee S. Luebke
*Assistant Examiner*—Chandrika Prasad
*Attorney, Agent, or Firm*—Jerry M. Presson; Michael R. Swartz

[57] ABSTRACT

A receptacle assembly includes a body adapted to receive a plug at one end, a cover having a top wall and a hinge having opposite upper and lower ends pivotally mounting the cover to the body for undergoing movement between an open condition and a closed condition relative to the body. The upper end of the hinge is in the form of a cap mounting the top wall of the cover such that the cover is rotatable relative to the hinge. The cover in the closed condition is rotatable between unlocked and locked positions relative to the body. The assembly further includes separate location and position indicator elements respectively in the form of a stationary arrowhead on the hinge cap and a pair of indicia in the form of words on the cover top wall being separately alignable with the stationary arrowhead upon rotation of the cover between the locked and unlocked positions. A first of the indicia on the cover is the word "open" referring to the unlocked position of the cover. A second of the indicia on the cover is the word "closed" referring to the locked position of the cover.

20 Claims, 4 Drawing Sheets

RECEPTACLE ASSEMBLY WITH COVER POSITION INDICATING MEANS

CROSS REFERENCE TO RELATED APPLICATION

Reference is hereby made to the following copending U.S. applications dealing with subject matter related to the present invention and assigned to the same assignee as this application:

(1) "Receptacle Assembly Having Position Retention Tabs" by Douglas A. Hopper, assigned U.S. Ser. No. 09/033,298 and filed Mar. 2, 1998. (760-30)

(2) "Receptacle Assembly With Improved Enclosure" by William C. Boteler, assigned U.S. Ser. No. 09/145,801 and filed Sep. 2, 1998. (911-0557)

BACKGROUND OF THE INVENTION

1. Field of the Invention

The present invention generally relates to electrical connectors of the type having plug and receptacle components for general and hazardous industrial applications and, more particularly, is concerned with a receptacle assembly having a cover position indicating means.

2. Description of the Prior Art

For many years a comprehensive selection of electrical products, namely, electrical fittings, enclosures, distribution equipment, connectors, controls and lighting fixtures, have been manufactured and sold by Killark Electric Manufacturing Company, a subsidiary of Hubbell Incorporated. These electrical products are designed for use in hazardous, hostile, corrosive and general industrial environments. More specifically, weather resistant electrical connectors having plugs and receptacles are designed as general purpose equipment for use in and around industrial plants, both indoors and outdoors, on portable and stationary apparatuses.

Commonly, an electrical connector receptacle has a body which is adapted to receive a plug at one end and a cover which is used to close the body when the receptacle is not in use. In closing the body, the cover engages and seals the open end of the receptacle preventing water from entering the body and contacting any electrical connections within the receptacle. The cover generally threadably screws onto the body. The cover is typically provided with a gasket and is attached to the body by means of a lanyard, chain, hinge or the like so that the cover cannot be misplaced when the receptacle is not in use.

A problem exists, however, in the prior art designs. When the cover engages the body, it is difficult to determine whether the cover has been rotated to a position where the cover makes its most secure fit with the body. None of the prior art designs provide a way for an electrician to make this determination without rotating the cover.

Consequently, a need still exists for a receptacle assembly which provides a solution to the aforementioned problem in the prior art without introducing any new problems in place thereof.

SUMMARY OF THE INVENTION

The present invention provides a receptacle assembly designed to satisfy the aforementioned need. The receptacle assembly of the present invention includes a cover position indicating means for an electrician to determine whether the cover has been rotated to the position where the cover makes its most secure fit or makes a less secure fit with the body.

This determination can be made without rotation of the cover. Separate cooperating location and position indicator elements making up the indicating means are respectively disposed on a hinge and the cover of the assembly and are easily viewable from above.

Accordingly, the present invention is directed to a receptacle assembly which comprises: (a) a body adapted to receive a plug at one end of the body; (b) a cover; (c) a hinge pivotally mounting the cover to the body for undergoing movement between an open condition and a closed condition relative to the body, the cover in the closed condition being rotatable between a less secure position and a more secure position relative to the body; and (d) means on the hinge and the cover for indicating when the cover is in the less and more secure positions. The cover has a top wall. The hinge has opposite upper and lower ends. The upper end of the hinge is in the form of a cap to which is mounted the top wall of the cover such that the cover is rotatable relative to the cap of the hinge. The hinge biases the cover toward the closed condition.

More particularly, the indicating means includes separate location and position indicator elements. The location indicator element defined on one of the hinge cap and cover top wall is a stationary pointer in the form of an arrowhead. The position indicator element defined on the other of the hinge cap and cover top wall is a pair of indicia in the form of words being separately alignable with the location indicator element upon rotation of the cover relative to the hinge. A first of the words is "open" which refers to the less secured, and more particularly unlocked, position of the cover. A second of the words is "closed" which refers to the more secured, and more particularly locked, position of the cover. Preferably, the location indicator element is defined on the hinge cap while the position indicator element is defined on the cover top wall. However, the places of the location and position indicator elements can be reversed with the location indicator element being on the cover top wall and the position indicator elements being on the hinge cap.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
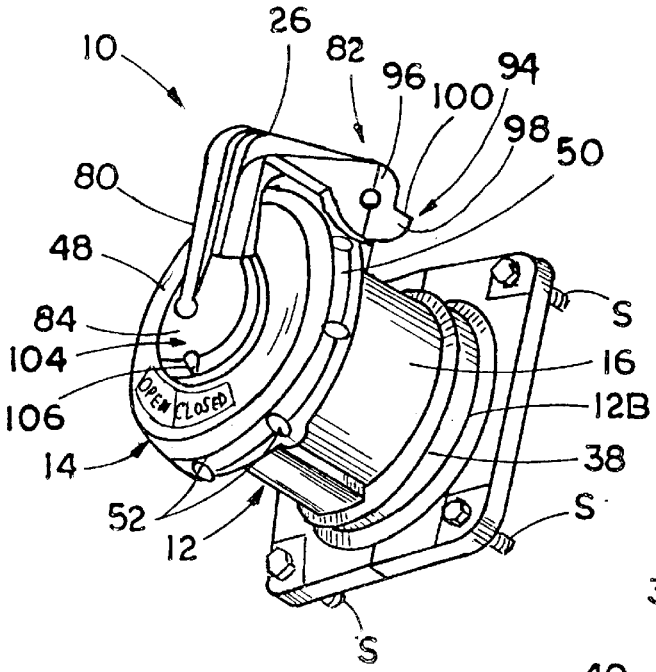
FIG. 1 is a perspective view of a receptacle assembly incorporating the features of the present invention, showing a cover of the assembly in a closed condition and in a locked position.

In the following description, like reference characters designate like or corresponding parts throughout the several views of the drawings. Also in the following description, it is to be understood that such terms as "forward", "rearward", "left", "right", "upwardly", "downwardly" and the like are words of convenience and are not to be construed as limiting terms.

Referring now to the drawings and particularly to FIGS. 1 to 7, there is illustrated a receptacle assembly, generally designated 10, incorporating the features of the present invention. The receptacle assembly 10 basically includes a body 12 and a cover 14. The body 12 has an open end 12A, an exterior surface 16 and a ridge 18 formed on and projecting outwardly from the exterior surface 16 adjacent to the open end 12A. The ridge 18 has at least one and, preferably, a pair of gaps or interruptions 20 defined or formed therein. The body 12 is adapted to receive a plug (not shown) at the open end 12A which places the assembly 10 in normal use. The cover 14 has an interior periphery 22 and at least one and, preferably, a pair of lugs or protrusions 24 formed on the interior periphery 22. Each protrusion 24 is alignable with one of the interruptions 20 of the ridge 18 of the body 12 and then movable through the respective one interruption 20 upon movement of the cover 14 toward the open end 12A of the body 12. Following thereafter, each protrusion 24 is movable into an underlying position relative to the ridge 18 of the body 12 upon rotation of the cover 14 relative to the body 12. Such combination of movements ensures that the cover 14 will be securely fitted over the open end 12A of and onto the body 12 when the assembly 10 is not in use. The assembly 10 further includes a hinge 26 pivotally mounting the cover 14 to the body 12 for undergoing movement between closed condition (FIG. 1) and an opened condition (FIG. 7) relative to the body 12. The hinge 26 also incorporates suitable means for biasing the cover 14 toward the closed condition.

Referring now to FIGS. 1 to 7 and 10, the body 12 of the assembly 10, more particularly, is substantially cylindrical in shape. The body 12 has the open end 12A at a top thereof and an opposite bottom open end 12B and defines a passageway 12C therethrough extending between the top and bottom open ends 12A, 12B. The body 12 may have a diameter at the top open end 12A larger than at the bottom open end 12B and of the same size as a diameter of the passageway 12C. The passageway 12C is provided for receiving any suitable electrical assembly (not shown), such as a socket or the like, for making any suitable or desired electrical connection with a plug (not shown) inserted through the top open end 12A. The body 12 has the exterior surface 16 and an interior surface 28. The interior surface 28 defines a pair of opposite recesses 30 for mounting a pair of ground straps 32 thereto. The ground straps 32 are each mounted by a ground strap rivet 34 to the body 12 toward a lower end thereof. The diameter of the bottom open end 12B is smaller than the diameter of the top open end 12A by virtue of an interiorly extending ledge 36 which narrows the passageway 12C at the bottom open end 12B. The exterior surface 16 has formed thereon the ridge 18 at a top thereof which surrounds and projects outwardly from the top open end 12A and an opposite bottom ridge 38 formed at a bottom thereof which surrounds and projects outwardly from the bottom open end 12B. The interruptions 20 are formed in the top ridge 18. The interruptions 20 are spaced 180 degrees apart from one another on opposite sides of the body 12. The top ridge 18 may define threads 40 thereon for engagement with a threaded ring on the plug (not shown). The top ridge 18 may also define smooth flat areas 42 interrupting the threads 40 on the top ridge 18. There is preferably a pair of flat areas 42 disposed adjacent to and on opposite sides of the body 12 from the recesses 30. The bottom ridge 38 may be smooth and uninterrupted. A generally rectangular shaped base or flange 44 is connected to and surrounds the body 12 at the bottom open end 12B and is provided with holes 46 at the corners of the flange 44. The flange 44 facilitates mounting the body 12 to a separate support structure (not shown). Mounting screws S are passed through respective ones of the holes 46 for mounting of the flange 44, and thereby for mounting of the entire assembly 10, to any desired location.

Referring now to FIGS. 1 to 14, the cover 14 of the assembly 10, more particularly, is substantially circular in shape. The cover 14 is rotatable between a less secured, and more particularly an unlocked, position as seen in FIG. 4A which permits the cover 14 to be removed from the body 12, and a more secured, and more particularly a locked, position as seen in FIG. 4 where the cover 14 is prevented from being removed from the body 12. The cover 14 has a diameter slightly greater than the diameter of the body 12 at the top open end 12A for fitting the cover 14 onto the body 12.

Figure 9:
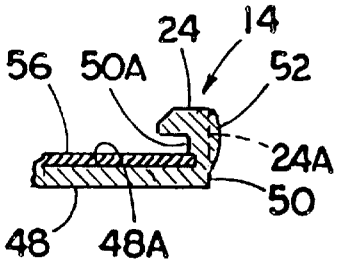
FIG. 9 is an enlarged fragmentary sectional view of the cover of the assembly taken along line 9—9 of FIG. 8.
Figure 10:
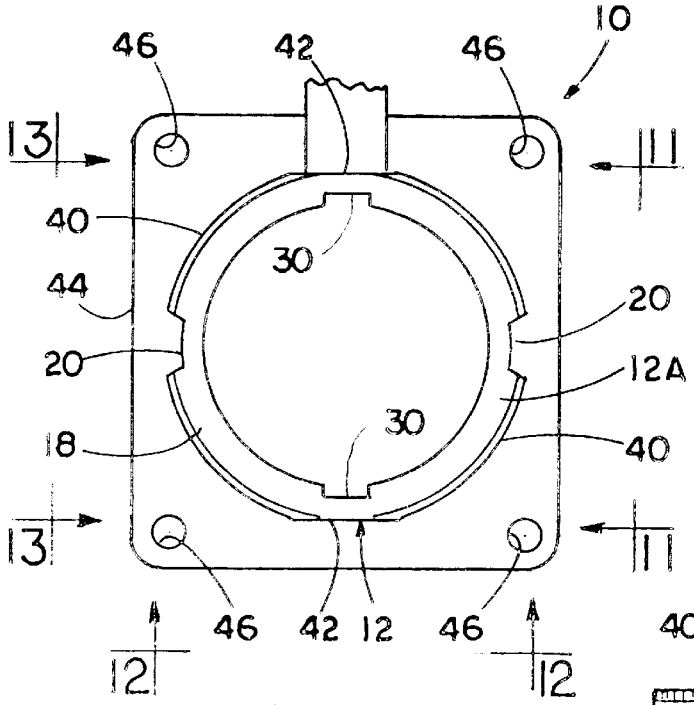
FIG. 10 is a top plan view of the body of the assembly showing a top ridge thereon having a pair of interruptions spaced about 180 degrees from one another.
Figure 11:
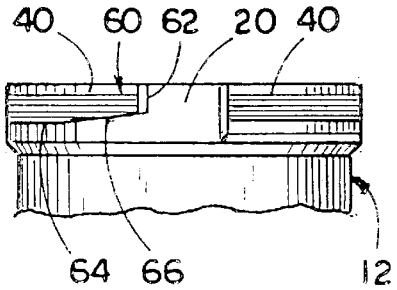
FIG. 11 is a side elevational view of the body of the assembly as seen along line 11—11 of FIG. 10 showing the top ridge of the body with one of the interruptions and having an inclined edge extending downwardly from a side edge adjacent to and bounding one side of the interruption to a lower edge of the ridge.
Figure 12:
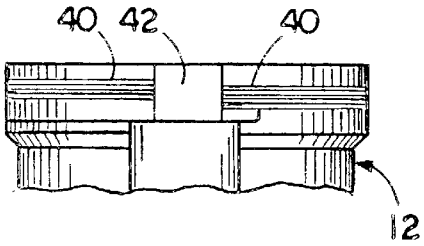
FIG. 12 is a front elevational view of the body of the assembly as seen along line 12—12 of FIG. 10.
Figure 13:
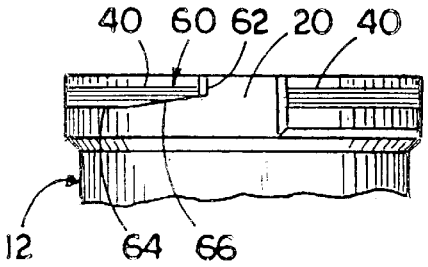
FIG. 13 is a side elevational view of the body of the assembly as seen along line 13—13 of FIG. 10 showing the opposite side of the body from that shown in FIG. 11.
Figure 14:
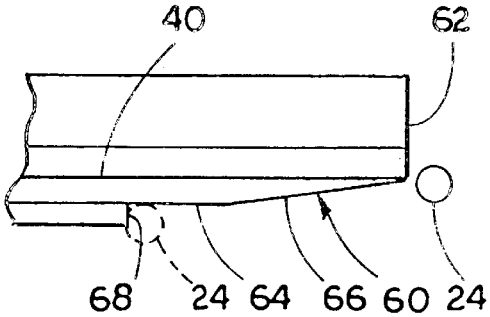
FIG. 14 is an enlarged detailed view of the top ridge of the body of the assembly showing one protrusion of the cover in the closed condition and in an unlocked position in solid line form at one end of the inclined edge of the ridge and the protrusion in the closed condition and locked position in dashed line form at the opposite end of the inclined edge of the ridge.

In accordance with features comprising the invention of the second copending patent application cross-referenced above, the interior periphery 22 of the cover 14 has the protrusions 24 which can be aligned with the interruptions 20 in the top ridge 18 on the exterior surface 16 of the body 12 and moved into the underlying position relative to the top ridge 18 of the body 12 when the cover 14 is rotated relative to the body 12 so as to retain the cover 14 in the more secured or locked position. The cover 14 has a top wall 48 and a side wall 50 which is continuous and is attached to and extends about and from the periphery 48A of the top wall 48 and defines the interior periphery 22 of the cover 14. The side wall 50 extends downwardly from the periphery 48A of the top wall 48 and defines the protrusions 24 interiorly therefrom. The side wall 50 also has a plurality of spaced apart gripping ridges 52 formed along an exterior surface thereof for aiding a user in rotating the cover 14. The top wall 48 of the cover 14 defines a central hole 54 used in mounting the cover 14 to the hinge 16. In cross-section as seen in FIG. 9, the top wall periphery 48A and peripheral side wall 50 together with each protrusion 24 have a substantially J-shaped or hook-like configuration facing interiorly toward an opposite side of the interior periphery 22 of the cover 14. The protrusions 24 are spaced 180 degrees apart from one another on opposite sides of the interior periphery 22 of the cover 14.

Figure 2:
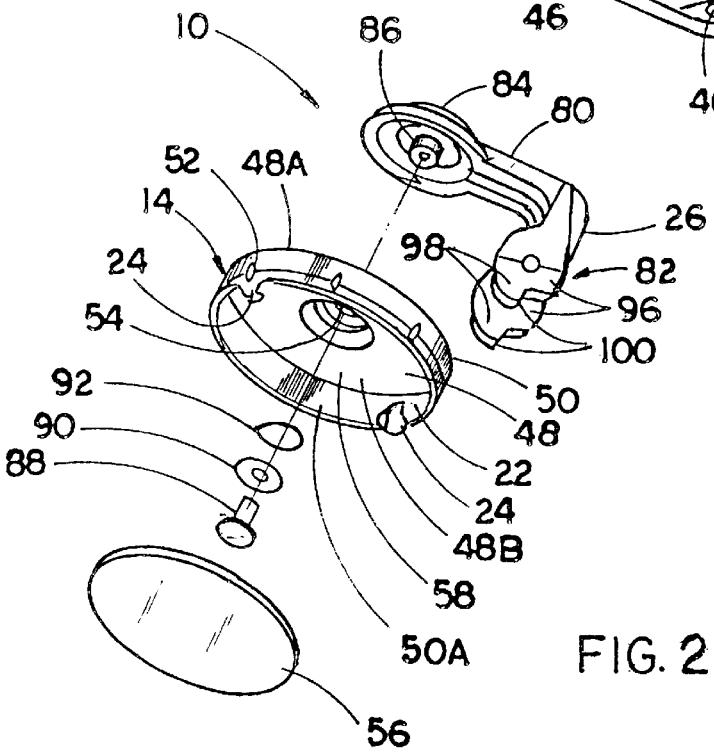
FIG. 2 is an exploded perspective view of the cover and a hinge of the receptacle assembly.
Figure 6:
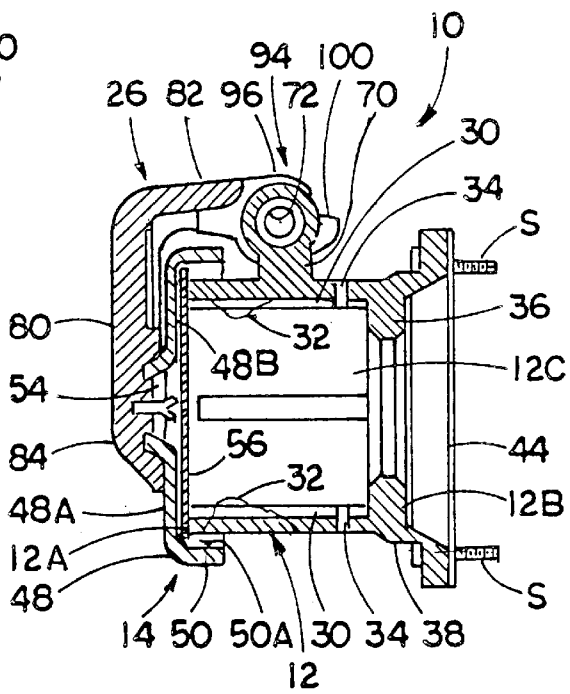
FIG. 6 is an axial sectional view of the assembly taken along line 6—6 of FIG. 4.
Figure 5:
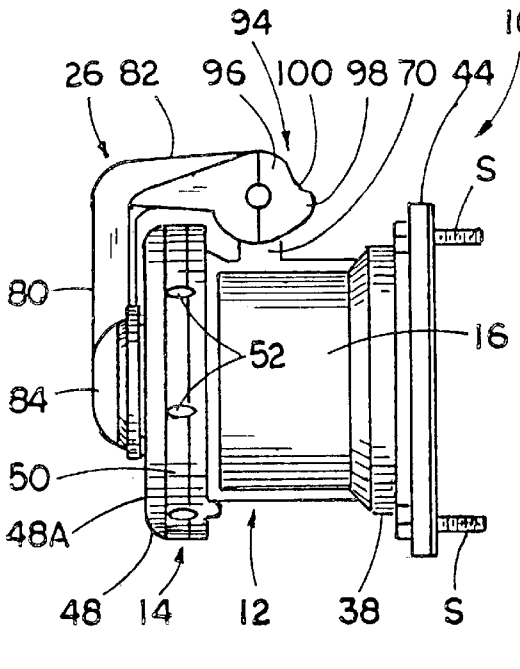
FIG. 5 is a side elevational view of the assembly as seen along line 5—5 of FIG. 4.

The assembly 10 further includes a gasket 56, as best seen in FIGS. 2 and 9. The top wall 48 and side wall 50 together provide interior surfaces 48B and 50A which form an interior surface 58 on the cover 14. The gasket 56 is mounted to the interior surface 48B of the top wall 48 of the cover 14. The gasket 56 is held loosely against the interior surface 48B of the top wall 48 of the cover 14 and is prevented from falling away from the cover 14 by the presence of protrusions 24 of the cover 14. The gasket 56 particularly abuts the protrusions 24 at a top end 24A thereof. The gasket 56 has a substantially flat and circular configuration and a diameter slightly less than the diameter of the cover 14 for fitting the gasket 56 within the interior periphery 22 of the cover 14. The gasket 56 is comprised of a substantially compressible material such that the gasket 56 will be compressed as the protrusions 24 move into the underlying position relative to the top ridge 18 of the body 12. The gasket 56 forms a seal between the cover 14 and the top open end 12A of the body 12 when the cover 14 is disposed in the closed condition relative thereto regardless of whether the cover 14 is further disposed in the less secured (or unlocked) or more secured (or locked) positions relative to the body 12.

Figure 7:
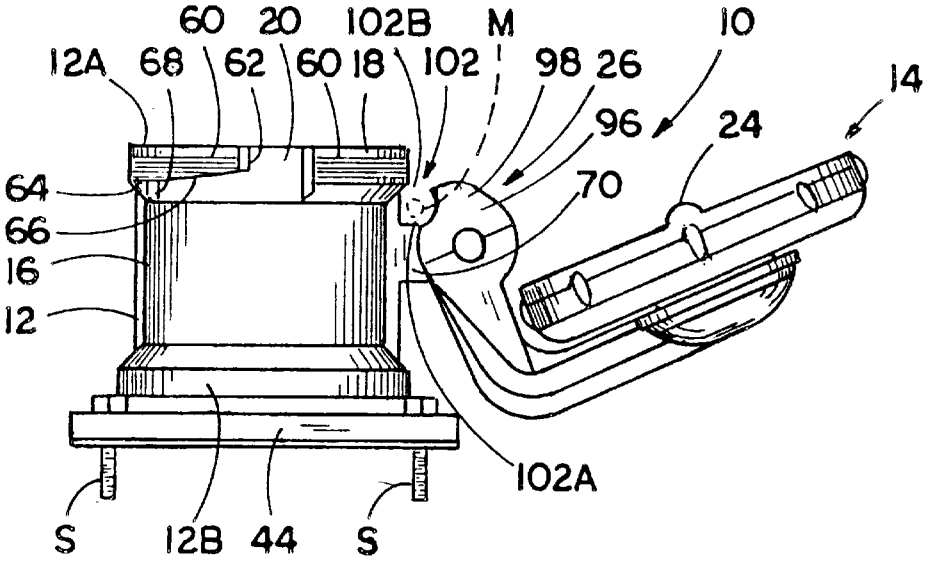
FIG. 7 is a side elevational view of the assembly similar to that of FIG. 5 but with the cover in an open condition.
Figure 8:
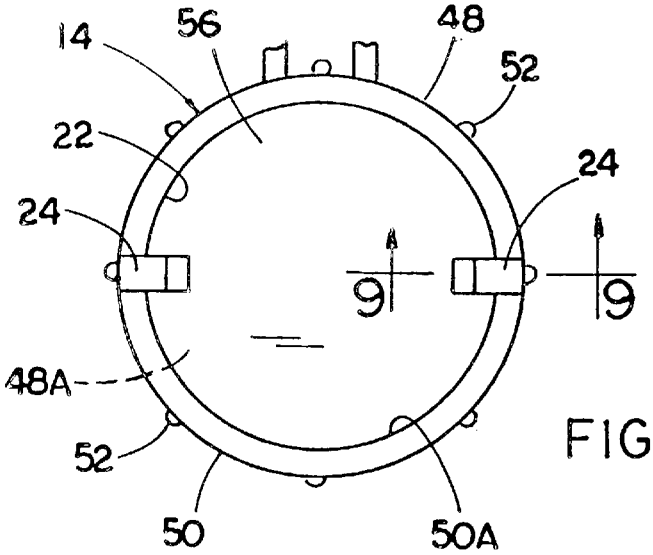
FIG. 8 is a bottom plan view of the cover of the assembly.

In its open condition of FIG. 7, the cover 14 is angularly displaced from the plug-receiving end of the body 12 allowing for mating of the plug (not shown) with the electrical assembly disposed within the body 12. In its closed condition of FIGS. 1, 4 and 4A, with the plug removed from the body 12, the cover 14 engages and seals the top open end 12A of the body 12 so as to prevent water from entering any of the electrical connections within the body 12. The cover 14 will automatically close when the plug is removed due to the bias of the hinge 26.

As best seen in FIGS. 8 to 14, in accordance with the second cross-referenced patent application, the top ridge 18 of the body 12 has at least one and, preferably, a pair of protrusion engagement portions 60. Each protrusion engagement portion 60 is defined by a side edge 62 adjacent to and bounding a side of a respective one of the interruptions 20 of the top ridge 18, a lower edge 64 extending in substantially perpendicular relation to the side edge 62, and an inclined cam edge 66 extending downwardly from the side edge 62 to the lower edge 64 such that the respective one protrusion 24 is movable from a less secured or unlocked position in the adjacent one of the interruptions 24 down the inclined edge 66 in the underlying position and into an increasingly more secured position relative to the top ridge 18 to a locked position against the lower edge 64 as the cover 14 is rotated relative to the body 12. The inclined cam edge 66 has a length greater than the length of the side edge 62 and greater than the length of the lower edge 64, though need not be so limited. The lengths of the side edge 62 and the lower edge 64 are approximately the same, though need not be so limited. The lengths and inclinations of the inclined cam edges 66 are such that only a fraction of a turn of the cover 14 is required to close the cover 14. The cover 14 is locked and sealed tightly onto the top open end 12A of the body 12 when a protrusion 24 is moved to an end of the lower edge 64 where an abutment 68 is defined by the top ridge 18. The gasket 56 is, more particularly, increasingly compressed as the protrusions 24 move down the inclined edges 66 into the underlying and increasingly secured positions relative to the top ridge 18 of the body 12. While the body 12 is shown with two protrusions 24 and the cover 14 is shown with two interruptions 20, they may have more than two.

Figure 3:
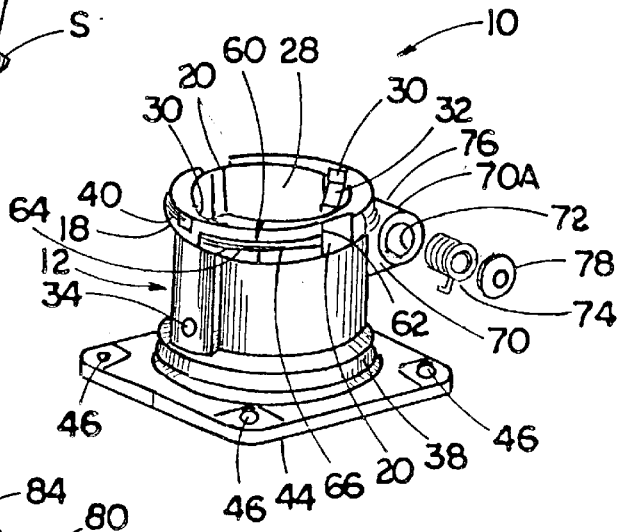
FIG. 3 is a perspective view of a body of the assembly showing a hinge mounting portion of the body exploded.
Figure 4:
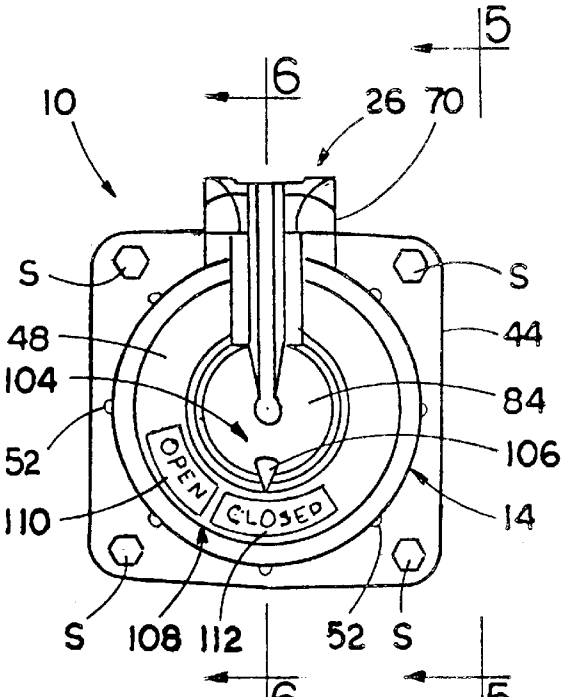
FIG. 4 is a top plan view of the assembly showing the cover in the closed condition and locked position.
Figure 4A:
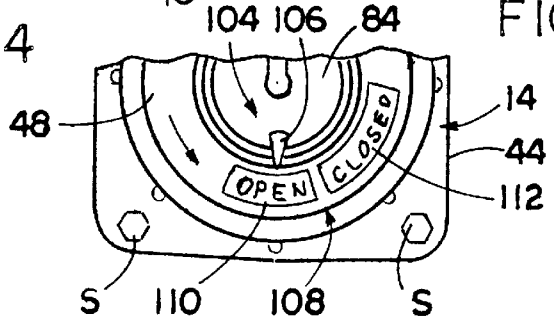
FIG. 4A is a fragmentary top plan view showing the cover in the closed condition and unlocked position.

As best seen in FIG. 3, the body 12 further has a hinge mounting portion 70. The hinge mounting portion 70 is substantially cylindrical in shape and has an end 70A defining an open passageway 72 therethrough. The hinge mounting portion 70 preferably is integrally connected to and extends outwardly from the body 12 between and spaced from the top and bottom ridges 18, 38 (but closer to the top ridge 18) on the exterior surface 16 of the body 12. The hinge mounting portion 70 has a spring 74 disposed within the passageway 72 thereof which is operable with the hinge 26 for biasing the cover 14 to the closed condition. The spring 74 is coiled and can be disposed on a spring guide 76. A hinge bushing 78 is disposed around an end of the spring guide 76 between the spring 74 and a portion of the hinge 26. One end of the spring guide 76 can be knurled for securing that end of the spring guide 76 to the hinge 26.

As seen in FIGS. 1, 2, 5 and 7, the hinge 26 has a substantially L-shaped configuration with a pair of opposite upper and lower ends 80, 82. The upper end 80 is in the form of a substantially annular cap 84. The lower end 82 is bifurcated. The cap 84 rotatably mounts the cover 14 at the top wall 48 thereof. As best seen in FIG. 2, the cap 84 has a screw receptacle 86 formed on an underside thereof which is aligned with the central hole 54 of the top wall 48 of the cover 14. The cap 84 is then mounted to the top wall 48 of the cover 14 by a cover screw 88 inserted through a spring washer 90, a wave spring 92 and the central hole 54 of the top wall 48 of the cover 14 and into the screw receptacle 86 of the cap 84 of the hinge 26.

In accordance with features comprising the invention of the first copending patent application cross-referenced above, the bifurcated end 82 of the hinge 26 defines a position retention means 94. The bifurcated end 82 of the hinge 26 preferably takes the form of a pair of spaced apart lugs 96 and the position retention means 94 takes the form of at least one and preferably a pair of tabs 98 laterally spaced apart from one another, each projecting peripherally outwardly from one of the lugs 96 and defining a shoulder 100 such that the shoulders 100 on the tabs 98 and the adjacent portion of the body 12 may retain a rod-shaped member M (not shown), such as a screwdriver or pencil, therebetween for holding the cover 14 adjacent to the open condition and blocking and preventing movement of the cover 14 from the open condition to the closed condition when the plug is not present at the top open end 12A of the body 12. The shoulders 100 preferably are relatively arcuate or concave in shape. The shoulders 100 generally face away from the body 12 when the cover 14 is located adjacent to its open condition. Also, the shoulders 100 in combination with the adjacent portion of the body 12 and the hinge mounting portion 70 form a channel-shaped gap 102 closed along a bottom 102A and open along a top 102B thereof for receiving and supporting the rod-shaped member M therein which, in turn, blocks pivotal movement of the hinge 26 and thereby the cover 14 to the closed condition.

In accordance with features comprising the present invention, the assembly 10 further includes an indicating means, generally designated 104, on the hinge 26 and the cover 14 for indicating, when the cover 14 at the closed condition, whether it is in the less secured, or more particularly unlocked, position (FIG. 4) or more secured, or more particularly locked, position (FIG. 4A). The indicating means 104 includes a location indicator element 106 and a position indicator element 108. More particularly, the location indicator element 106 is a stationary pointer specifically taking the form of an arrowhead defined on the annular cap 84 of the hinge 26. The position indicator element 108 is a pair of indicia 110,112 specifically taking the form of a pair of words defined on the top wall 48 of the cover 14. The words 110,112 are separately alignable with the arrowhead 106 upon rotation of the cover 14 relative to the hinge 26. A first 110 of the words 110, 112 on the top wall 48 of the cover 14 is "open" and refers to the less secured or unlocked position of the cover 14 wherein the cover 14 is in the closed condition with the protrusions 24 formed on the interior periphery 22 of the cover 14 merely aligned with the interruptions 20 of the ridge 18 of the body 12. A second 112 of the words 110,112 on the top wall 48 of the cover 14 is "closed" and refers to the more secured or locked position of the cover 14 wherein the cover 14 is in the closed condition with the protrusions 24 formed on the interior periphery 22 of the cover 14 underlying the ridge 18 of the body 12, upon movement of the protrusions 24 through the interruptions 20 of the ridge 18 and rotation of the cover 14 relative to the body 12, to thereby securely fit the cover 14 over the open end 12A of and onto the body 12 when the assembly 10 is not in use. The words 110, 112, "open" and "closed", on the top wall 48 of the cover 14 are alignable with the stationary arrowhead 106 on the cap 84 of the hinge 26.

To summarize, the cover 14 is in one or the other of the unlocked and locked positions when the respective indicia 108, or words 110, 112, "open" and "closed", formed thereon are separately aligned with the stationary arrowhead 106 on the hinge 26, as best seen in FIGS. 4A and 4. The above-described indicator means 104 on the hinge 26 and cover 14 allows an electrician to determine whether the cover 14 has been rotated to the position where the cover 14 makes its most secure fit with the body 12 (in the locked position) or makes a less secure fit with the body 12 (in the unlocked position). The indicator means 104 is easily viewable from above.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A receptacle assembly, comprising:

(a) a body adapted to receive a plug at one end of said body;

(b) a cover;

(c) a hinge pivotally mounting said cover to said body for undergoing movement between an open condition and a closed condition relative to said body, said cover also being rotatable mounted to said hinge such that in said closed condition said cover is rotatable between a less secured position and a more secured position relative to said body; and (d) indicating means on said hinge and said cover for indicating when said cover is in said less and more secured positions.

2. The assembly as recited in claim 1, wherein said hinge biases said cover toward said closed condition.

3. The assembly as recited in claim 1, wherein said indicating means includes separate location and position indicator elements.

4. The assembly as recited in claim 3, wherein said location indicator element defined on one of said hinge and cover is a stationary pointer.

5. The assembly as recited in claim 4, wherein said pointer is in the form of an arrowhead.

6. The assembly as recited in claim 3, wherein said location indicator element is defined on said hinge.

7. The assembly as recited in claim 3, wherein said position indicator element defined on the other of said hinge and cover is a pair of indicia separately alignable with said location indicator element upon rotation of said cover relative to said hinge.

8. The assembly as recited in claim 7, wherein said indicia are words.

9. The assembly as recited in claim 8, wherein a first of said words is "open" and refers to said less secured position of said cover.

10. The assembly as recited in claim 9, wherein a second of said words is "closed" and refers to said more secured position of said cover.

11. The assembly as recited in claim 3, wherein said position indicator element is defined on said cover.

12. A receptacle assembly, comprising:

(a) a body adapted to receive a plug at one end of said body;

(b) a cover having a top wall;

(c) a hinge having opposite upper and lower ends, said upper end of said hinge being in the form of a cap and rotatably mounted to said top wall of said cover such that said cover is rotatable relative to said cap of said hinge, said hinge at said lower end being pivotally mounted to said body for undergoing pivotal movement of said cover between an open condition and a closed condition relative to said body, said cover in said closed condition being rotatable between an unlocked position and a locked position relative to said body; and (d) limiting means on said cap of said hinge and said top wall of said cover for indicating when said cover is in said unlocked and locked positions.

13. The assembly as recited in claim 12, wherein said hinge biases said cover toward said closed condition.

14. The assembly as recited in claim 12, wherein said indicating means includes separate location and position indicator elements.

15. The assembly as recited in claim 14, wherein said location indicator element defined on one of said cap of said hinge and said top wall of said cover is a stationary pointer.

16. The assembly as recited in claim 15, wherein said pointer is in the form of an arrowhead.

17. The assembly as recited in claim 15, wherein said pointer is defined on said cap of said hinge.

18. The assembly as recited in claim 14, wherein said position indicator element defined on the other of said cap of said hinge and said top wall of said cover is a pair of indicia separately alignable with said location indicator upon rotation of said cover relative to said hinge.

19. The assembly as recited in claim 18, wherein said indicia are defined on said top wall of said cover.

20. The assembly as recited in claim 18, wherein said indicia are words, a first of said words being "open" and referring to said unlocked position of said cover, a second of said words being "closed" and referring to said locked position of said cover.

* * * * *